United States Patent [19]

Hofmann

[11] Patent Number: 4,688,954

[45] Date of Patent: Aug. 25, 1987

[54] SINGLE PASS INK RIBBON CASSETTE FOR TYPEWRITERS OR SIMILAR MACHINES

[75] Inventor: Norbert Hofmann, Nuremberg, Fed. Rep. of Germany

[73] Assignee: Triumph-Adler A.G., Fed. Rep. of Germany

[21] Appl. No.: 916,480

[22] Filed: Oct. 7, 1986

Related U.S. Application Data

[63] Continuation of Ser. No. 738,176, May 28, 1985, abandoned.

[30] Foreign Application Priority Data

Jun. 8, 1984 [DE] Fed. Rep. of Germany ..... 3421406

[51] Int. Cl.[4] ..... B41J 32/00; B41J 33/14

[52] U.S. Cl. ..... 400/208; 400/227.1

[58] Field of Search ..... 400/191, 194, 195, 196, 400/196.1, 207, 208, 208.1, 210, 227, 227.1, 247, 248

[56] References Cited

U.S. PATENT DOCUMENTS

| | | | |
|---|---|---|---|
| 1,548,217 | 8/1925 | Sherrod | 400/248 X |
| 2,102,693 | 12/1937 | Garbell | 400/194 X |
| 2,103,734 | 12/1937 | Schmidt | 400/194 |
| 4,051,944 | 10/1977 | Starr | 400/195 |
| 4,341,479 | 7/1982 | Sanada | 400/208 |
| 4,511,902 | 4/1985 | Nagashima | 400/227.1 X |

*Primary Examiner*—Paul T. Sewell

*Attorney, Agent, or Firm*—Browdy and Neimark

[57] ABSTRACT

A single pass ink ribbon cassette for typewriters or like machines is designed to track ribbon extending between a supply and take-up spool in such a manner that text contained on used ribbon beyond a point of impression is rendered illegible. Used ribbon is rendered illegible in that upon its entry into the cassette, it is guided around a turn around roller for passage past the point of impression a second time before re-entry again into the cassette, and conducted via guide means for take-up by a driven take-up spool. Due to the fact that the ink ribbon is guided past the point of impression a second time, subsequent impressions on the used ribbon render the text from the used ribbon unreadable. In addition, in the zone of the turn around roller a scraper is provided for scraping the residual ink particles off the used ribbon before it is guided past the point of impression the second time.

3 Claims, 1 Drawing Figure

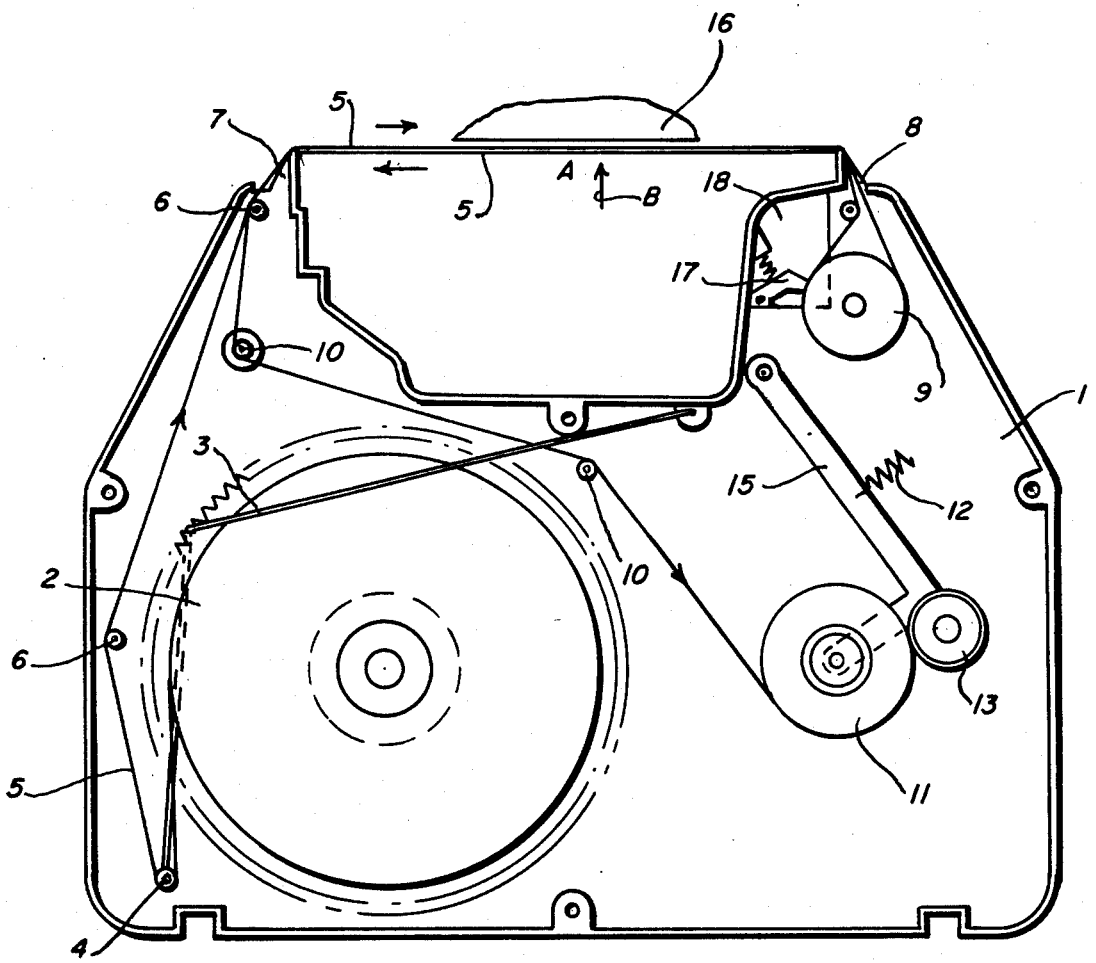
16
5
7
8
A
B
18
6
5
17
10
9
1
3
15
12
10
2
6
13
5
11
4

SINGLE PASS INK RIBBON CASSETTE FOR TYPEWRITERS OR SIMILAR MACHINES

This application is a continuation of application Ser. No. 738,176, filed May 28, 1985, now abandoned.

The invention relates to an ink ribbon cassette for typewriters or similar machines adapted to render the text contained on single pass ribbons illegible; more particularly, it relates to a cassette having means for tracking ribbon past a printing point twice.

Devices for rendering texts on used single-pass ribbons have become known in several forms. DE-PS No. 32 01 84 shows and describes a device where, after entry into the ink ribbon cassette, the ribbon is guided between two rollers which are equipped with barbs and/or depressions. Such a deformation of the ribbon renders the text contained on the ribbon illegible. In DE-OS No. 32 17 416 a number of devices are described which serve the same purpose. A disadvantage of these known devices is that they considerably increase the cost of the cassette. This is felt to be an unfavorable feature especially in view of the fact that the cassette is thrown away after the ribbon has been used up. According to some of the proposals in the above-noted patent disclosure, the coil on the take-up spool is to be agglomerated by heating or with adhesive or with a suitable solvent in such a way that it is no longer possible to read the writing. Realization of these proposals likewise means a substantial cost increase of the cassette.

The disadvantages of the prior art are overcome in accordance with the invention by a ribbon tracking system in the cassette which moves used ribbon past the printing point of the machine twice by means of turnaround roller means. Due to the fact that the ribbon is again guided past the point of impression between a fresh ribbon portion and the print wheel, characters are again impressed on the used ribbon, so that the characters already printed are printed over again. Thus, printed text, readable after the first reproduction, becomes illegible.

Additionally, the invention lends itself to the provision in the region of the turnaround roller of a scraper for scraping off the remaining ink particle residues after the first typing on the ribbon to thereby render the reading of the text more difficult if not impossible. In cassettes provided with such scrapers, a collection or catch zone below the scraper is provided to catch scraped-off ink particles to thereby avoid fouling of the typewriter mechanisms by the ink particles. The catch zone may be located directly in the cassette or alternatively it may be provided in a removeable container located on the machine below an opening in the bottom wall of the cassette.

An object of the invention is to provide a device for garbling the text on an ink ribbon without adding significantly to the cost of the cassette.

Another object of the invention is in the provision of a cassette having a ribbon tracking system whereby used ribbon is again tracked past the printing point of a machine.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

The single FIGURE is a view of a cassette with the cover removed showing the ribbon tracking system of the invention.

Referring now to the drawing, there if shown a cassette housing 1 in which a supply spool 2 is rotatably mounted. Attached to the free end of a spring arm 3 is a guide roller 4, around which single-pass ink ribbon 5 coming off the supply spool 2 is guided. A bend in spring 3, in cooperation with notches in the periphery of the supply spool 12, acts as a ribbon tensioner in a known manner. Around additional guide rollers 6, which are arranged in accordance with the model of the cassette, the unused ribbon 5 is conducted out through a first opening 7 on one side of the cassette, past the point of impression A, and back into the cassette through a second opening 8 on the other side. After such entry of used ribbon 5 into cassette 1, the used ribbon 5 is immediately conducted around a turnaround roller 9, and again out opening 8 for passage past the point of impression A, and reentry back into the cassette through the first opening 7. Additional guide means in the form of posts or rollers 10 guide the ribbon to the take-up spool 11, which under the action of spring 12 urges it against a driver roller 13 adapted to be coupled to ribbon feed mechanism in the typewriter in a known manner when the cassette is mounted. The drive roller 13 may be provided with barbs known in themselves, which bring about a sure rotational entrainment of the take-up spool 11. In the embodiment shown in the drawing, the take-up spool 11 is mounted on a swivel lever 15 which, as the diameter of the take-up spool 11 increases, is deflected toward the supply spool 2 counter to the action of spring 12.

As can be seen from the drawing, at first the unused ink layer of ribbon 5 moving from left to right is on the side toward a platen, indicated by 16. After running around the turn around roller 9, the now used ink layer moving right to left faces the housing of the cassette 1. Now if the direction of arrow B a character impression takes place as by the impact of a type ball or print disc through both the used and unused ribbon, characters on the used ribbon 5 are deformed and rendered illegible. Essentially the desired effect is achieved in that the ribbon 5 is impressed once for printing during its passage in left to right direction and once again during its passage in right to left direction, past the printing point A.

To support the desired effect there may be provided additonally in the region of the turnaround roller 9 a scraper 17 which is preferably spring-biased against the used ribbon 5 to scrape ink particles off the ink support foil. It is thereby achieved that large parts of the used ink layer are removed and thereby further assuring the text contained on the used ribbon will be rendered illegible. The scraped-off ink particles may be stored in a catch zone 18. This catch zone 18 may be provided, e.g., as a depression on the bottom of the cassette 1. However, as already mentioned, it is possible also to let the ink particles fall through a cutout in the cassette into a catch zone which is detachably provided in the machine. Thus, it can be emptied from time to time.

Naturally the invention can be realized also in ink ribbon cassettes in which the take-up spool is not movably mounted in the cassette.

The invention claimed is:

1. In a single-pass ribbon cassette for typewriters or like machines having mounted thereon a supply and a take-up spool, the latter of which is adapted to be driven by typewriter ribbon feed mechanisms incident to typing when the cassette is mounted in said typewriter, said cassette having first and second spaced openings to allow ribbon to be drawn off said supply spool through said first and second openings and to be taken up by said take-up spool with the length of ribbon between said openings external of the cassette passing a printing point, a ribbon turnaround roller supported in said cassette adjacent said second opening for redirecting said ribbon entering said second opening out of said second opening for movement past the pinting point a second time in the opposite direction and again into said first opening for take up by said take-up spool whereby type impressions on said redirected ribbon will be rendered illegible by type impressions made by subsequent typing, and ribbon guide means in said cassette for guiding said ribbon movement between said supply and take-up spools.

2. A cassette as recited in claim 1, including a scraper means mounted in the cassette for engaging used ribbon tracking about said turnaround roller.

3. A cassette as recited in claim 2, including means below said scraper for collecting scraped off inked particles.

* * * * *